United States Patent [19]

Locker

[11] 4,313,823

[45] Feb. 2, 1982

[54] SIEVE DEVICE FOR SEPARATING A MIXTURE OF PARTICULATE MATERIAL IN COMPONENTS OF DIFFERENT SIZES

[75] Inventor: Jan A. K. Locker, Steenwijk, Netherlands

[73] Assignees: Machinefabriek A. Wijnveen B.V., Ede; Cooperative Landbouw aan- en verkoopcombinatie, B.A. "C.L.C.", Steenwijk, both of Netherlands

[21] Appl. No.: 196,090

[22] Filed: Oct. 10, 1980

[30] Foreign Application Priority Data

Oct. 12, 1979 [NL] Netherlands ..... 7907587

[51] Int. Cl.[3] ..... B07B 1/08

[52] U.S. Cl. ..... 209/369; 310/51

[58] Field of Search ..... 209/364, 369, 350, 351, 209/271, 279, 280, 365 R, 365 B, 243; 310/51, 80, 83

[56] References Cited

U.S. PATENT DOCUMENTS

| | | | |
|---|---|---|---|
| 1,976,588 | 10/1934 | Thearle | 310/51 X |
| 2,269,245 | 1/1942 | Blessing | 310/51 X |
| 2,353,763 | 7/1944 | Rodman | 310/51 X |
| 2,915,181 | 12/1959 | Topp | 209/279 X |
| 3,417,868 | 12/1968 | Donelson, Jr. | 209/279 X |
| 3,989,435 | 11/1976 | Allen et al. | 209/350 X |

*Primary Examiner*—William A. Cuchlinski, Jr.

*Attorney, Agent, or Firm*—Andrus, Sceales, Starke & Sawall

[57] ABSTRACT

A sieve device for separating a mixture of particulate material into components of different sizes has a rotating perforated sieve surface and a central, vertical shaft. The central vertical shaft is coupled to a drive set. A reaction arm is fastened to the drive set and embraces a rod mounted between brackets on the lower portions of the sieve device housing. Helical springs extend between each side of the reaction arm and the brackets so that shock loads applied to the shaft can be resiliently met by the reaction arm.

2 Claims, 2 Drawing Figures

SIEVE DEVICE FOR SEPARATING A MIXTURE OF PARTICULATE MATERIAL IN COMPONENTS OF DIFFERENT SIZES

BACKGROUND OF THE INVENTION

The invention relates to a sieve device for separating a mixture of particulate material into components of different sizes, comprising a perforated sieve surface rotated by a central, vertical shaft, said sieve surface having the shape of a hollow, truncated cone casing with a downwardly directed apex, in which in the middle an impervious distributor cone has been mounted having an upwardly directed apex. The base of the distributor cone joins the sieve surface. The supply of the mixture to be separated takes place via a central supply tube placed above the distributor cone, whereas the removal of the coarse component takes place near the circumference of the sieve surface. The central, vertical shaft is coupled with a drive set.

A sieve device of this type is known from the Netherlands patent application No. 7,605,572 laid open to public inspection. Although the operation of this device is fast, good and dependable, especially when used for separating the coarse pressing pellets of animal fodder from the grits that have formed therefrom, a sudden or unregular supply of amounts of mixture on the sieve surface may cause shock or impact loads in the drive set and the central shaft, which cause wear that may finally give rise to break down of the operation.

SUMMARY OF THE INVENTION

The object of the invention is obviating this drawback and providing a sieve device, in which shock or impact loads are resiliently met, so that the components of the drive set have a much longer duration of life and operational break downs are precluded.

This object is attained according to the invention, in that in the drive set, at least one spring device is arranged.

By application of the invention shock or impact loads coming from the sieve surface are resiliently met, that in the spring device whereby wear of the components of the drive set are precluded.

A preferred embodiment of the invention, the central, vertical shaft is coupled with the gear box, that, in turn, is coupled with an electrical motor. The spring device comprises a horizontal reaction arm fastened to the gear box, said arm carrying a fork at its free end, which fork engages around a rod extending at substantially right angles to the reaction arm. The rod is mounted between two brackets fastened to the lower wall of the housing of the device. Between each side of the fork and each bracket a helical spring is mounted and placed between spring cups. The consequence thereof is, that the shocks and impacts between the shaft and the drive set can be resiliently met at the outside of the device.

DESCRIPTION OF THE DRAWINGS

The invention will now further be elucidated referring to the accompanying drawing of some embodiments given as examples.

DESCRIPTION OF THE ILLUSTRATED EMBODIMENT

Figure 1:
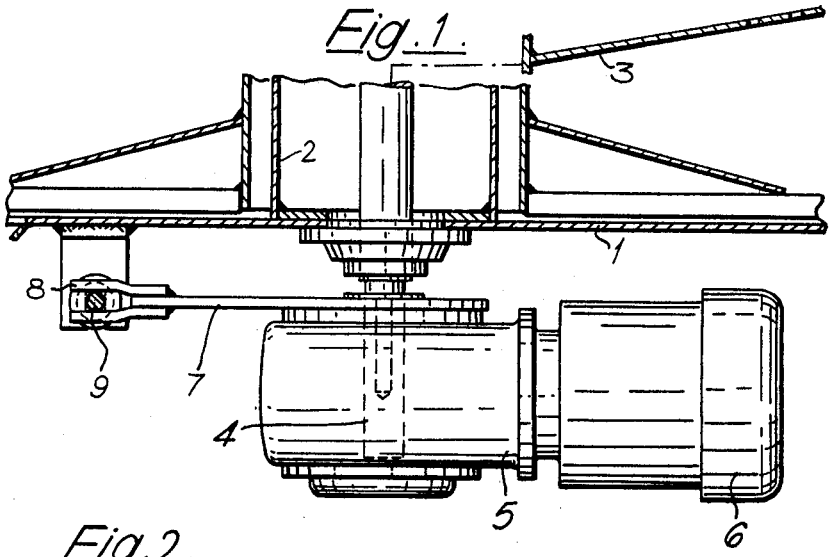
FIG. 1 is a side view in partial cross section of a preferred embodiment of the invention.
Figure 2:
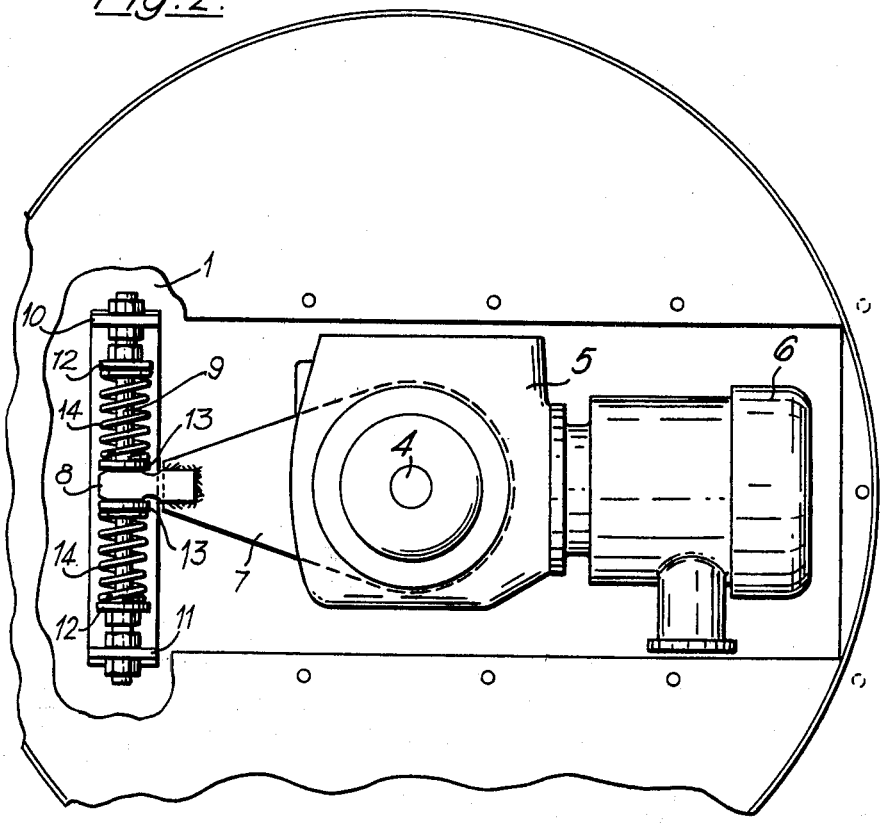
FIG. 2 is a view of the underside of the device according to FIG. 1.

In the sieve device illustrated in the drawing only the drive part is shown.

In the middle of the housing 1 a central drive shaft 4 is mounted, which protrudes, at the lower side, outside the housing 1 and is coupled with a gear box 5 that is suspended beneath the housing 1. An electrical drive motor 6 is fastened on gear box 5. Inside the housing 1, surrounded by the fixed bushing 2, the shaft 4 is mounted for providing a rotary drive to the sieve device 3. For details of the structure of sieve device 3, reference is made to Netherlands patent application No. 7605572 laid open to public inspection.

This shaft 4 is coupled with a reducing gear box 5, of which the input shaft (not shown) is coupled with the electrical motor 6. When sudden amounts of mixture to be separated are brought on the sieve surface of the sieve device 3, this can cause shocks or impacts on the shaft 4. For resiliently meeting these shocks or impacts the gear box 5 includes a horizontal reaction arm 7 which carries a fork 8 at its free end. Fork 8 engages around a rod 9 extending at a substantially right angle to the reaction arm 7. This rod 9 is mounted between two brackets 10, 11 that are fastened to the lower wall of the housing 1 of the device. Between each vertical side of the fork 8 and each bracket 10, 11 a helical spring 14 is mounted that is placed between the spring cups 12, 13. This spring device compensates for the reaction forces transmitted by the reaction arm 7, whereby no damage to the drive set may occur.

The invention is not limited to the embodiment shown and/or described, but extends to all variations thereof.

The embodiments of the invention in which an exclusive property or privilege is claimed are defined as follows:

1. In a sieve device for separating a mixture of particulate material into components of different sizes, said sieve device having a perforated sieve surface rotated by a central vertical shaft in a housing, improved means for compensating for torsional shock loads applied to the sieve surface and shaft wherein said shaft is mounted on said housing and rigidly coupled to a drive means for positioning the latter adjacent the housing, and wherein a spring device extends normal to said shaft and is interposed between said drive means and housing for resiliently absorbing said torsional shock loads.

2. The improved means according to claim 1, in which the central, vertical shaft is coupled with a gear box, that in turn is coupled with the electrical motor, wherein the spring device comprises a horizontal reaction arm mounted to one of the gear box and electric motor, said reaction arm carrying a fork at its free end, said fork embracing a rod extending substantially at right angles to the reaction arm, said rod being mounted between two brackets that are fastened to the housing of the device, and between each vertical outside edge of the fork and each bracket a helical spring surrounding said rod is mounted and placed between spring cups.

* * * * *